US009260902B2

(12) United States Patent
Erskine et al.

(10) Patent No.: US 9,260,902 B2
(45) Date of Patent: Feb. 16, 2016

(54) SLIDING ROOF WINDOW

(71) Applicant: Taylor Made Group, LLC, Gloversville, NY (US)

(72) Inventors: Edward J. Erskine, Benson, NY (US); Michael Trajlinek, Johnstown, NY (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 14/483,904

(22) Filed: Sep. 11, 2014

(65) Prior Publication Data

US 2015/0075078 A1 Mar. 19, 2015

Related U.S. Application Data

(60) Provisional application No. 61/877,515, filed on Sep. 13, 2013.

(51) Int. Cl.
*E05F 15/643* (2015.01)

(52) U.S. Cl.
CPC ..... *E05F 15/643* (2015.01); *E05Y 2201/214* (2013.01); *Y10S 292/20* (2013.01); *Y10S 292/47* (2013.01); *Y10T 292/1051* (2015.04)

(58) Field of Classification Search
CPC ..... E05C 3/004; E05C 3/006; E05C 3/008; E05C 3/12; Y10S 292/20; Y10S 292/47; B63B 19/24; E05F 15/643
USPC ..... 49/139, 140, 141, 449
See application file for complete search history.

(56) References Cited

U.S. PATENT DOCUMENTS

| | | | | |
|---|---|---|---|---|
| 3,526,994 | A * | 9/1970 | Delaney | 49/199 |
| 3,858,452 | A * | 1/1975 | Gatland et al. | 74/424.78 |
| 4,628,636 | A * | 12/1986 | Folger | 49/199 |
| 4,905,542 | A * | 3/1990 | Burm et al. | 74/625 |
| 5,077,938 | A * | 1/1992 | Moreuil | 49/362 |
| 5,445,207 | A * | 8/1995 | Romanelli et al. | 160/209 |
| 5,581,939 | A * | 12/1996 | Regan et al. | 49/139 |
| 5,644,869 | A | 7/1997 | Buchanan, Jr. | |
| 5,787,636 | A | 8/1998 | Buchanan, Jr. | |
| 6,227,613 | B1 | 5/2001 | Maciejewski et al. | |
| 6,343,436 | B1 * | 2/2002 | Milano et al. | 49/362 |
| 6,840,010 | B2 * | 1/2005 | Chen et al. | 49/139 |
| 6,840,567 | B2 | 1/2005 | Fushimi et al. | |
| 7,234,502 | B2 * | 6/2007 | O'Malley | 160/191 |
| 8,235,454 | B2 | 8/2012 | Heuel et al. | |

* cited by examiner

*Primary Examiner* — Katherine Mitchell
*Assistant Examiner* — Marcus Menezes
(74) *Attorney, Agent, or Firm* — Nixon & Vanderhye P.C.

(57) ABSTRACT

A release mechanism for selectively connecting and disconnecting a sliding power window from a movable drive block includes a release knob and a release bracket coupled with the release knob by a cable or rod. The release bracket is pivotable between a locked position and a released position by displacement of the release knob. The release bracket includes a drive block pin engageable with the movable drive block and a locking block pin engageable with a fixed locking block. The mechanism allows a boat operator to operate a sliding roof/window manually in case of power failure or the like. The mechanism enables the window to be locked in the opened or closed position, and no tools are required to release the drive or to position/lock the sliding roof/window.

14 Claims, 5 Drawing Sheets

SLIDING ROOF WINDOW

CROSS-REFERENCES TO RELATED APPLICATIONS

This application claims the benefit of U.S. Provisional Patent Application Ser. No. 61/877,515, filed Sep. 13, 2013, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

The invention relates to a sliding roof window and, more particularly, to a release mechanism for a sliding roof window.

With existing powered roof windows, the window can be stuck in an open or closed position in the event of power failure. In a marine environment, a stuck open window can be particularly troublesome in the event of wet weather. It would be desirable to provide for manual operation of a sliding roof window in case of power failure or other drive mechanism problems. It would also be desirable to provide for locking the window in the open or closed position in the event of power failure or the like.

BRIEF SUMMARY OF THE INVENTION

The release mechanism according to preferred embodiments allows for manual operation of the roof window in case of power failure or other mechanism failure. The release mechanism enables the window to be locked in the opened or closed position, and no tools are required to operate the manual control.

In an exemplary embodiment, a release mechanism for selectively connecting and disconnecting a sliding power window from a movable drive block includes a release knob, a release bracket coupled with the release knob by a cable or rod, and a spring. The release bracket is pivotable between a locked position and a released position by displacement of the release knob. The release bracket includes a drive block pin engageable with the movable drive block and a locking block pin engageable with a fixed locking block. The spring is cooperable with the release bracket and biases the release bracket to the locked position. The release bracket may include a pivot bracket connected to a bracket frame by a pivot bolt, where the drive block pin and the locking block pin are attached to the pivot bracket. In this context, the spring may be a torsion spring coupled to the pivot bolt and acting on the pivot bracket. The release bracket may be positioned on one side of a window unit, where the release knob is positioned remotely. The drive block pin may be spaced from the locking block pin along a direction in which the window opens and closes.

In another exemplary embodiment, a window assembly includes a window unit displaceable in a window frame between an open position and a closed position, a movable drive block coupled with the window unit, a fixed locking block secured to the window frame, and the release mechanism for selectively connecting and disconnecting the window unit from the movable drive block. The release mechanism may be coupled with the window unit. The assembly may include an auxiliary locking block disposed at an opposite end of the window frame from the fixed locking block.

In yet another exemplary embodiment, a release mechanism for selectively connecting and disconnecting a sliding power window from a movable drive block includes a release knob, and a release bracket coupled with the release knob by a cable or rod, where the release bracket is pivotable between a locked position and a released position by displacement of the release knob. The release bracket includes a drive block pin engageable with the movable drive block and a locking block pin engageable with a fixed locking block, where the drive block pin is spaced from the locking block pin along a direction in which the window opens and closes.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
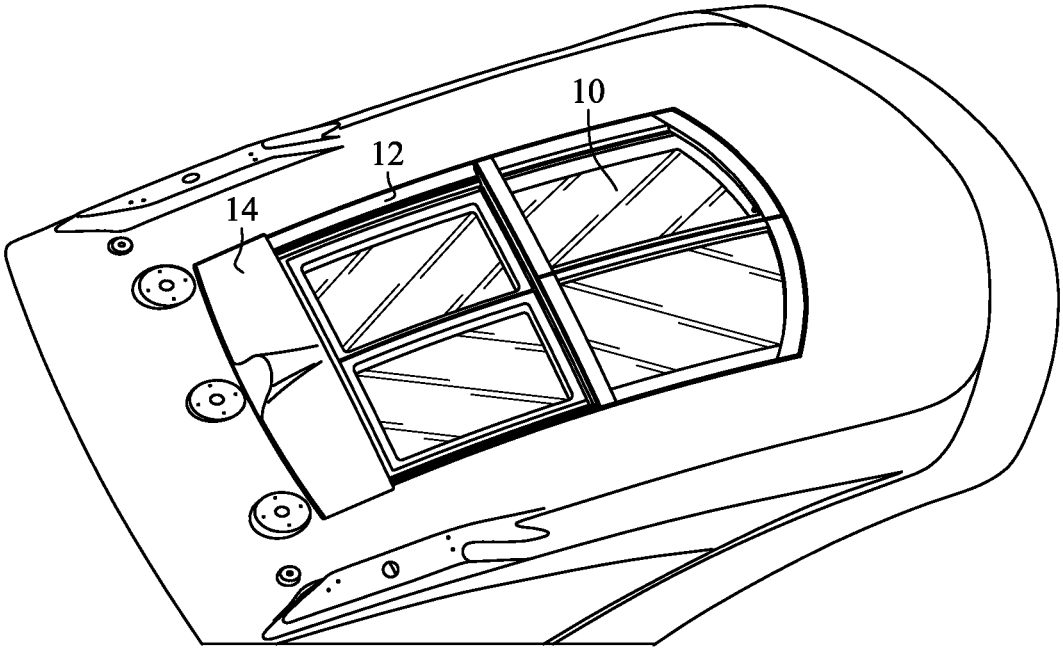
FIG. 1 is a plan view of a sliding roof window.

FIG. 1 is a plan view of a sliding roof window or window unit 10 that is displaceable in a recessed casing and window frame 12 between a closed position (shown in FIG. 1) and an open position. The window unit 10 is displaceable via a power drive mechanism disposed inside a cover assembly 14 in FIG. 1. The drive mechanism is known, and details thereof will not be further described. An exemplary drive system is manufactured by Taylor Made Systems of Gloversville, N.Y.

Figure 2:
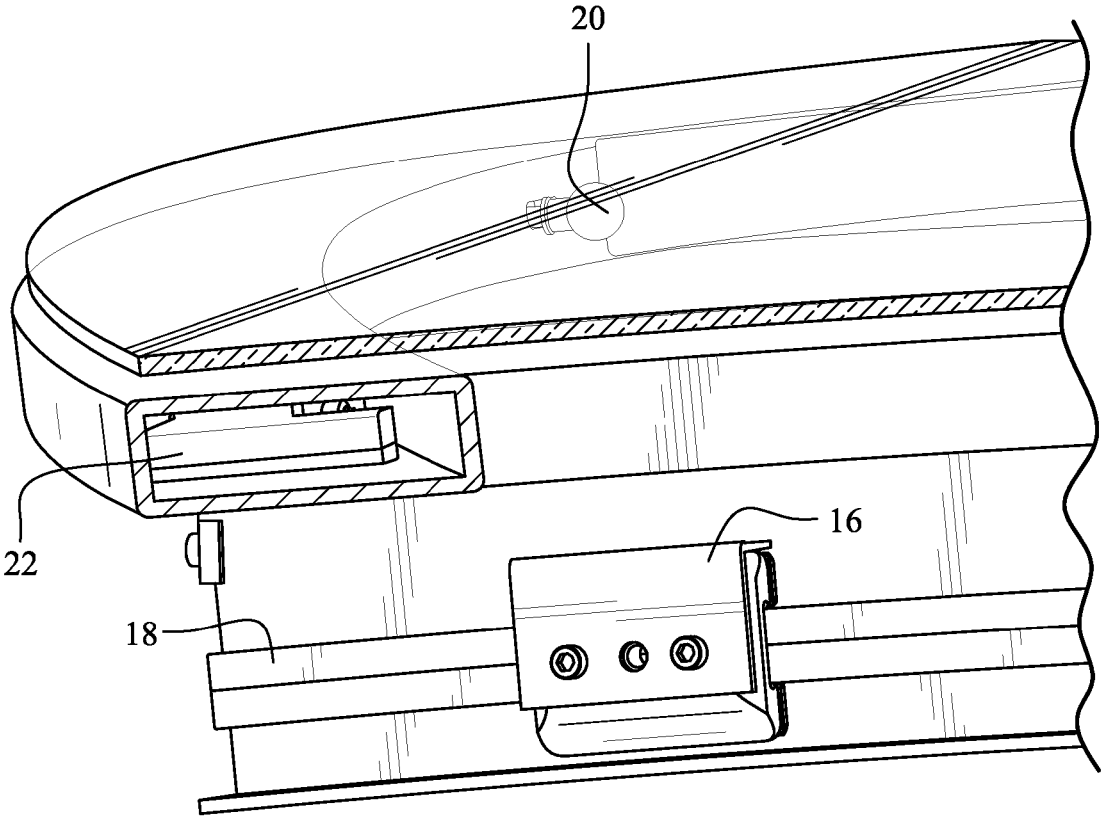
FIG. 2 shows an exterior view of the release mechanism.

FIG. 2 shows an exterior view of the release mechanism. The window unit 10 is fixed for movement on a bearing car 16 or the like that rides on a track 18. The release mechanism is attached to the window unit 10 for displacement with the window unit and includes a release knob 20, which deflects a release bracket 22 via a cable or rod 23 (see FIG. 4). The release knob 20 is accessible by the boat operator from inside the boat.

Figure 3:
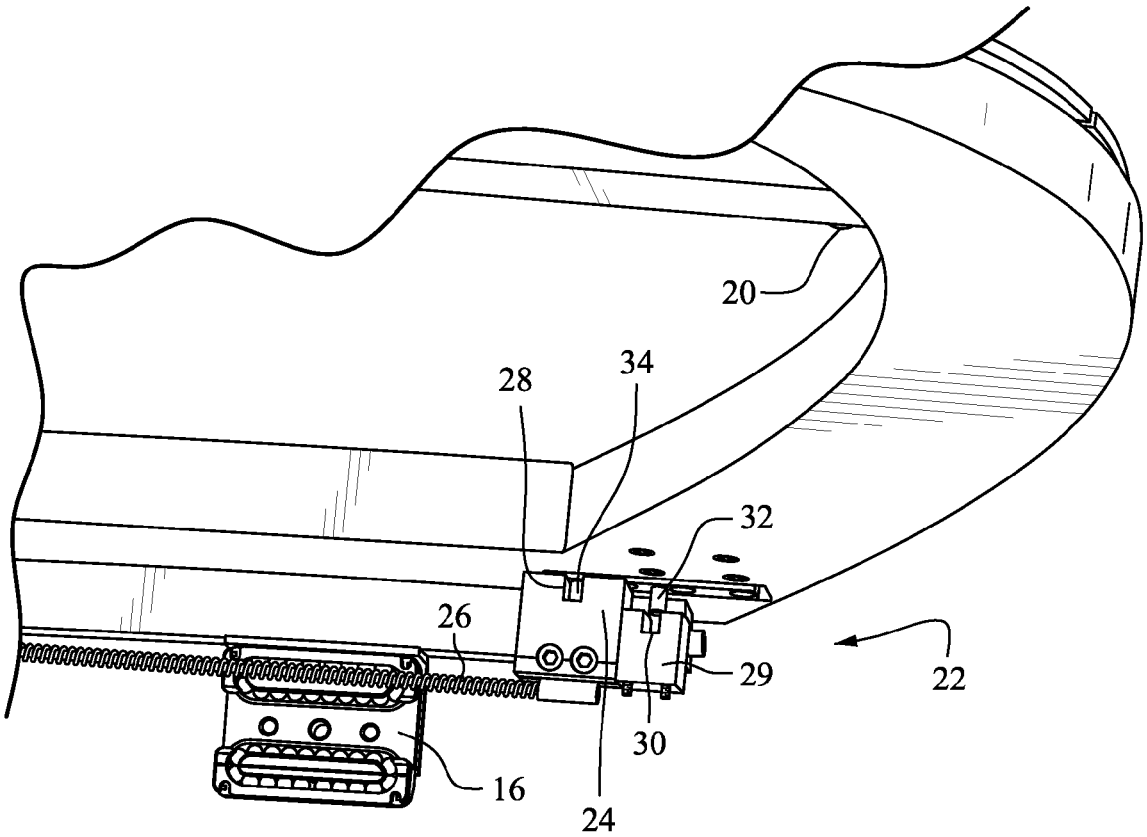
FIG. 3 shows the mechanism from the inside with the track removed.

FIG. 3 shows the mechanism from inside with the track/cover removed. The mechanism includes a drive block 24, preferably formed of plastic, with two bolts as shown that drives the window back and forth via a spiral cable or rod 26 coupled with the drive system. The release mechanism also includes a drive block pin 34 that is received in a slot 28 in the drive block 24. A locking block 29 similarly includes a slot 30, but its locking block pin 32 does not engage in the position in FIG. 3 because the mechanism is engaged with the drive block 24. The drive block pin 34 is spaced from the locking block pin 32 along a direction in which the window opens and closes. As such, when the window unit is displaced to the closed position, the position will be the same regardless of whether the window unit is closed manually or by the drive system.

Figure 4:
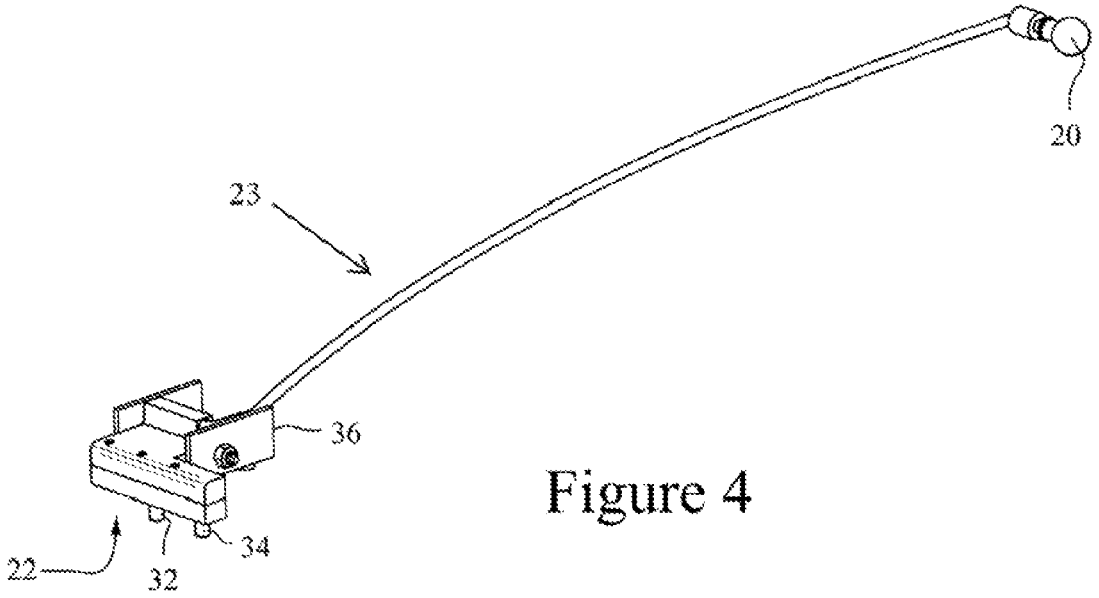
FIG. 4 is an isolated view of the release mechanism.
Figure 6:
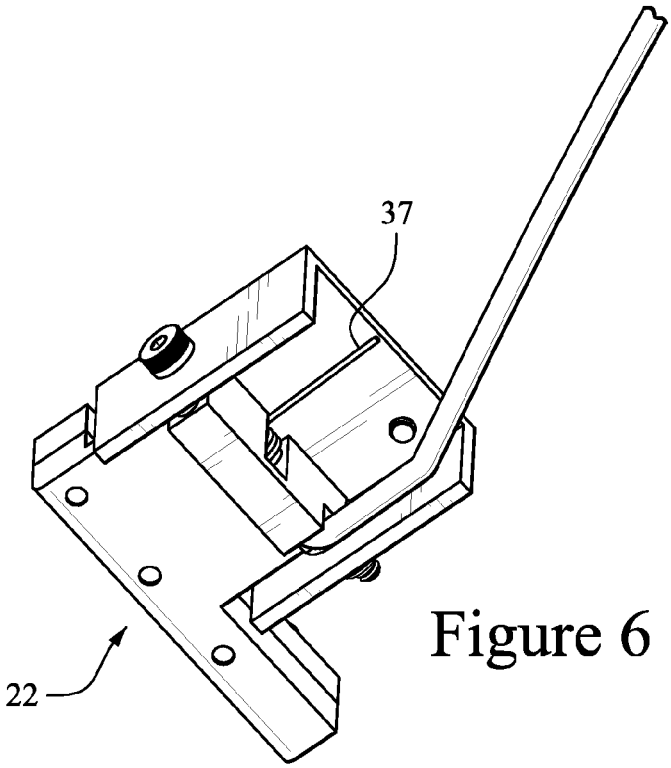
FIGS. 6-8 are mechanical drawings of the release mechanism.
Figure 7:
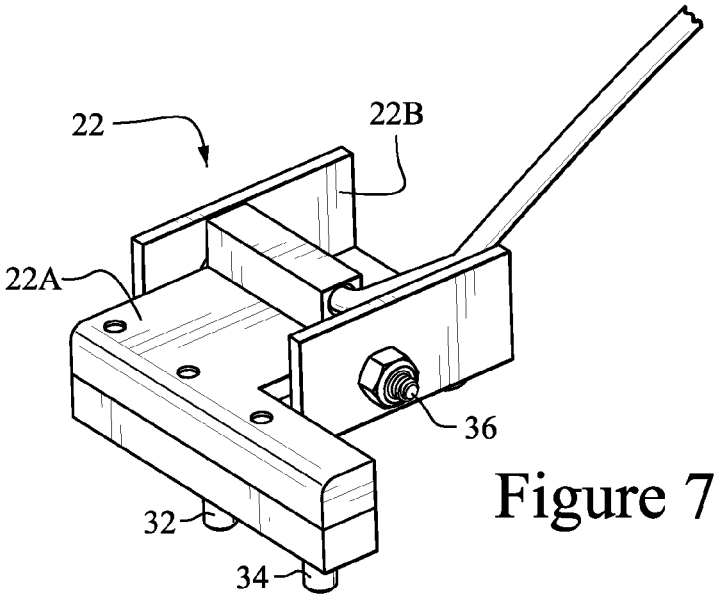
Figure 8:
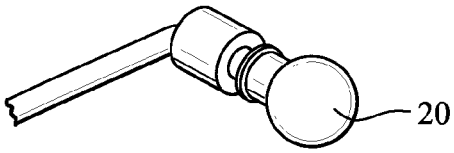

FIG. 4 is an isolated view of the release mechanism, and FIGS. 6-8 are mechanical drawings of the mechanism. The release bracket 22 of the release mechanism includes a pivot bracket 22A pivotably connected to a pivot frame 22B by a pivot bolt 36. The pins that selectively engage slots 28, 30 are shown. In FIG. 4, the drive block pin 34 is engageable with the slot 28 in the drive block 24, and the locking block pin 32 is engageable with the slot 30 in the locking block 29. When the knob 20 is displaced to the right (in the drawings—starboard, for example), the release bracket 22 is pivoted up and around the pivot bolt 36, which pulls the pins 32, 34 up. A torsion spring 37 (shown in FIG. 6) is preferably coupled with the pivot bolt 36 and biases the release mechanism 22 down, against the deflection of the release bracket 22 by the knob 20. With the release bracket pivoted upward, the pin 34 disengages the drive block 24, and the window unit is free to slide on the track with no power. That is, the boat operator can simply pull the knob 20 to release the window unit from the power system, and the window unit can freely slide back and forth.

In use, assume a scenario where the window is halfway open, and the mechanism experiences a power failure. If it is desired to close the window, the operator displaces the knob 20 to release the drive mechanism (in this example, with reference to FIG. 3, the drive block 24 would have been driven somewhere off to the left in FIG. 3 when the window was opened). With the drive mechanism released, the window can be manually slid closed where the locking block pin 32 is aligned with the slot 30 in the locking block 29. In this alignment, the locking block pin 32 drops into the slot 30, and the window is locked shut even with the power disabled.

Figure 5:
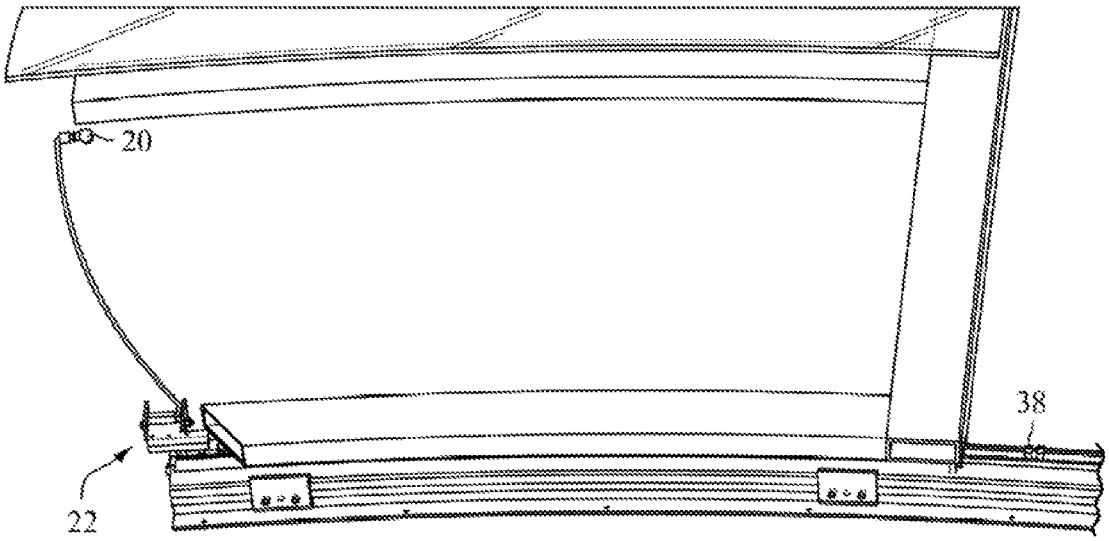
FIG. 5 shows the release mechanism attached to a window unit.

FIG. 5 shows the window frame including the release bracket 22 and the knob 20. Like block 29, an auxiliary block 38 is added at an opposite end of the window path. In the event of a power failure, the window can also be locked in the open position manually by activating the release mechanism via the knob 20, manually opening the window, and when the window reaches its max open position, the pin 34 will engage a corresponding slot in the auxiliary block 38.

The mechanism allows a boat operator to operate a sliding roof window manually in case of power failure or the like. The mechanism enables the window to be locked in the opened or closed position, and no tools are required to release the drive or to position/lock the sliding roof window.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A release mechanism for selectively connecting and disconnecting a sliding power window from a movable drive block, the release mechanism comprising:

a release knob;

a release bracket coupled with the release knob by a cable or rod, wherein the release bracket is pivotable between a locked position engaged with the movable drive block and a released position by displacement of the release knob such that with the release bracket in the locked position, displacement of the release knob pivots the release bracket from the locked position to the released position, the release bracket including a drive block pin engageable with the movable drive block and a locking block pin engageable with a fixed locking block; and a spring cooperable with the release bracket and biasing the release bracket to the locked position, wherein the release bracket comprises a pivot bracket connected to a bracket frame by a pivot bolt, the pivot bracket being pivotable about the pivot bolt, and wherein the drive block pin and the locking block pin are directly attached to the pivot bracket.

2. The release mechanism according to claim 1, wherein the spring comprises a torsion spring coupled with the pivot bolt and acting on the pivot bracket.

3. The release mechanism according to claim 1, wherein the release bracket is positioned on one side of a window unit, and wherein the release knob is positioned remotely from the release bracket.

4. The release mechanism according to claim 1, wherein the drive block pin is spaced from the locking block pin along a direction in which the window opens and closes.

5. A window assembly comprising:

a window unit displaceable in a window frame between an open position and a closed position;

a movable drive block coupled with the window unit and with a drive system for displacing the window unit by displacing the movable drive block;

a fixed locking block secured to the window frame; and a release mechanism for selectively connecting and disconnecting the window unit from the movable drive block and from the fixed locking block, the release mechanism comprising:

a release knob, a release bracket coupled with the release knob by a cable or rod, wherein the release bracket is pivotable between a locked position engaged with the movable drive block or the fixed locking block and a released position by displacement of the release knob such that with the release bracket in the locked position, displacement of the release knob pivots the release bracket from the locked position to the released position, the release bracket including drive block pin engageable with the drive block and a locking block pin engageable with the fixed locking block, wherein the locking block pin is engageable with the fixed locking block with the window unit released from the drive system, and a spring cooperable with the release bracket and biasing the release bracket to the locked position, wherein the release bracket comprises a pivot bracket connected to a bracket frame by a pivot bolt, the pivot bracket being pivotable about the pivot bolt, and wherein the drive block pin and the locking block pin are directly attached to the pivot bracket.

6. The window assembly according to claim 5, wherein the release mechanism is coupled with the window unit.

7. The window assembly according to claim 5, wherein the spring comprises a torsion spring coupled with the pivot bolt and acting on the pivot bracket.

8. The window assembly according to claim 5, wherein the release bracket is positioned on one side of the window unit, and wherein the release knob is positioned remotely from the release bracket.

9. The window assembly according to claim 5, wherein the drive block pin is spaced from the locking block pin along a direction in which the window unit opens and closes.

10. The window assembly according to claim 5, further comprising an auxiliary locking block disposed at an opposite end of the window frame from the fixed locking block.

11. A release mechanism in combination with a sliding power window including a window unit, the release mechanism selectively connecting and disconnecting the sliding power window from a drive system, the release mechanism and sliding power window comprising:

a movable drive block coupled with the window unit and with the drive system for displacing the window unit by displacing the movable drive block;

a fixed locking block secured adjacent the window unit and separate from the window unit;

a release knob; and a release bracket coupled with the release knob by a cable or rod, wherein the release bracket is pivotable between a locked position engaged with the movable drive block or the fixed locking block and a released position by displacement of the release knob such that with the release bracket in the locked position, displacement of the release knob pivots the release bracket from the locked position to the released position, the release bracket including a drive block pin engageable with the movable drive block and a locking block pin engageable with a fixed locking block, wherein the drive block pin is spaced from the locking block pin along a direction in which the window opens and closes, and wherein the locking block pin extends along a longitudinal axis in a direction perpendicular to the direction in which the window opens and closes such that with the drive block pin engaged with the movable drive block, the locking block pin is spaced from the fixed locking block.

12. The release mechanism and sliding power window according to claim 11, further comprising a spring cooperable with the release bracket and biasing the release bracket to the locked position.

13. The release mechanism and sliding power window according to claim 12, wherein the release bracket comprises a pivot bracket connected to a bracket frame by a pivot bolt, and wherein the drive block pin and the locking block pin are attached to the pivot bracket.

14. The release mechanism and sliding power window according to claim 13, wherein the spring comprises a torsion spring coupled with the pivot bolt and acting on the pivot bracket.

* * * * *